US006402344B1

(12) United States Patent
Palazzo

(10) Patent No.: US 6,402,344 B1
(45) Date of Patent: Jun. 11, 2002

(54) LINEAR EFFECTS DEVICE FOR A PROJECTION SYSTEM

(76) Inventor: Paul Palazzo, 343 Adelphi St., Brooklyn, NY (US) 11238

( * ) Notice: Subject to any disclaimer, the term of this patent is extended or adjusted under 35 U.S.C. 154(b) by 0 days.

(21) Appl. No.: 09/203,422

(22) Filed: Dec. 2, 1998

(51) Int. Cl.[7] ..... F21V 9/00

(52) U.S. Cl. ..... 362/283; 362/268; 362/324; 40/433

(58) Field of Search ..... 362/283, 293, 362/268, 324; 40/431, 433, 435

(56) References Cited

U.S. PATENT DOCUMENTS 4,843,528 A 6/1989 Pearce-Harvey et al.
4,891,738 A 1/1990 Richardson et al.
4,984,143 A * 1/1991 Richardson ..... 362/293
5,113,332 A * 5/1992 Richardson ..... 362/282
5,282,121 A 1/1994 Bornhorst et al.
5,402,326 A 3/1995 Belliveau
5,406,176 A 4/1995 Sugden
5,426,576 A * 6/1995 Hewlett ..... 362/293
5,537,303 A 7/1996 Stacy
5,739,604 A * 4/1998 Summerland ..... 310/73
5,791,755 A * 8/1998 Henry et al. ..... 353/120
5,823,661 A * 10/1998 Mahanay et al. ..... 362/293

* cited by examiner

*Primary Examiner*—Sandra O'Shea
*Assistant Examiner*—John Anthony Ward
(74) *Attorney, Agent, or Firm*—Coudert Brothers LLP

(57) ABSTRACT

A linear effects device for independently and simultaneously rotating two effects discs within a single axis for use in a conventional illumination system. The rotation of the second effects disc modifies the continuous image generated by the rotation of the first effect disc.

9 Claims, 4 Drawing Sheets

LINEAR EFFECTS DEVICE FOR A PROJECTION SYSTEM

BACKGROUND OF THE INVENTION

The present invention relates to a lighting system for stage, theater, architectural and display illumination and, more particularly, to a linear effects device for use in a light projection or illumination system.

Conventional theatrical and display lighting systems use various types of patterning discs which are removable insertable into light beams, to modify the distribution of light in the projected beam. For this purpose, a projection gate is often used to form the desired image across the beam of light. Typically, the projection gates are embodied as shutters or etched masks, commonly referred to as "gobos" or "gobo discs", that function like stencils in the beam path to project a particular beam configuration or an image pattern. That is, a gobo disc masks the light beam except where a pattern is cut out of the disc, such as star-shaped aperture in the disc.

Known arrangements include rotary assemblies that incorporate several pattern generating elements arranged around an axis of rotation, along with a drive mechanism for rotating a selected pattern into the beam path. Usually several different gobo discs together with optical filters and/or shutters are distributed in respective apertures circumferentially of a carrier wheel or a gobo wheel. The carrier wheel is rotatable to index a desired gobo disc into the path of the light beam.

Also, the selected gobo disc in the carrier wheel may be additionally rotated to project a moving image pattern. For example, U.S. Pat. No. 5,537,303 (Stacy) describes that gobo discs to be rotated may be located in respective gobo holders which have toothed peripheries engaging a sun gear coaxial with a gobo wheel, so that rotation of the sun gear relative to the gobo wheel rotates each gobo disc in its gobo holder.

U.S. Pat. No. 4,891,738 (Richardson et al.) describes that a selected aperture holder (gobo holder) containing a pattern aperture plate and centered on an optical axis may be spun by a holder drive mechanism. Richardson's holder drive mechanism comprises a motor which is selectively operated in either direction at a selected speed to turn a belt against a rim of the aperture holder and rotate the pattern aperture plate intersected by the light beam around the optical axis.

U.S. Pat. No. 5,739,604 (Summerland) describes using a gobo disc which may be rotated as the rotor of an electric motor. The stator of the motor is provided by coils disposed on a fixed mounting about the rotatable gobo disc. In order to act as the rotor of an electric motor, the periphery of a gobo disc is made magnetically discontinuous by giving it a toothed periphery for a ferrous gobo disc or by placing mutually spaced ferrous inserts at the periphery of a non-ferrous gobo disc.

However, the provision of the toothed gobo discs or toothed gobo holders, bearings, gears or belts to rotate the gobo discs represent a high manufacturing cost which has a considerable impact on the price of lighting or illumination unit as a whole. Moreover, to be effective, these disc rotating mechanisms must function in a densely packed, compact and sometimes highly mobile structure housing both very fragile optical and electronic components together with a light source capable of producing oven-like temperatures. In addition, certain types of lighting instruments are designed to be portable and must withstand truck transport abuses and the vagaries of weather.

Each of the above lighting systems permits only one gobo disc having a single image pattern to be rotated within the path of the light beam. That is, each of the above lighting systems is capable of projecting or illuminating only a single image moving through the projection gate. The present invention proceeds upon the desirability of providing a portable linear effects device to efficiently and inexpensively provide linear effects capabilities in a conventional illumination system.

The linear effects device of the present invention permits a conventional illumination system to project a continuous image through the projection gate, such as clouds moving across the sky. In addition, the present invention enables a conventional illumination system to provide additional linear effects by varying the continuous image projected through the gate, such as changing the shape of the clouds as they move across the sky or modifying the placid clouds into storm clouds. Stated otherwise, the present invention provides linear effects capability to a conventional illumination system by independently rotating two effects discs within the path of the light beam to change the shape of the continuous image pattern or to add shaded areas to the continuous image pattern.

SUMMARY OF THE INVENTION

Therefore, it is an object of the present invention to provide an inexpensive linear effects device for independently and simultaneously rotating two effects discs about a single axis for use in a conventional illumination system. The rotation of the second effects disc modifies the continuous image generated by the rotation of the first effects disc.

Another object of this invention is to provide a device which is operable with various types of effects discs, such as metal, plastic or glass effects discs.

A further object of this invention is to provide a device which includes template holders for mounting a static template.

In accordance with this invention, the linear effects device comprises a housing for removably receiving a first effects disc containing a first image pattern and a second effects disc containing a second image pattern therewithin. The housing has first and second ends, each end having an opening to permit a beam of light to pass. The first and second ends being positioned in a beam of light projected by an illumination system such that light enters the housing through the opening in the first end, passes through the two effects discs and exits the housing through the opening in the second end. A first motor is connected to the housing for independently and controllably rotating the first effects disc across a beam of light to project a continuous image of the first image pattern. A second motor is also connected to said housing for independently and controllably rotating the second effects disc to modify the continuous image generated from the first image pattern.

Various other objects, advantages and features of the present invention will become apparent from the ensuing detailed description.

BRIEF DESCRIPTION OF THE DRAWINGS

The following detailed description, given by way of example, and not intended to limit the present invention solely thereto, will best be understood in conjunction with the accompanying drawings in which.

DETAILED DESCRIPTION OF PREFERRED EMBODIMENTS

The present invention is embodied in a unique apparatus for producing special linear effects by simultaneously and independently rotating two effects discs about a single axis. The effects discs of the present invention may be made of metal, plastic, clear glass, colored glass or other suitable material. The image pattern on the effects disc may be used to project a continuous image of clouds, rain, snow, fire or the like. It is appreciated that art work on the effects disc may be customized to create a desired image pattern. The linear effects device of the present invention may be used in a wide variety of light projection or illumination systems, such as the system illustrated in FIG. 1.

Figure 1:
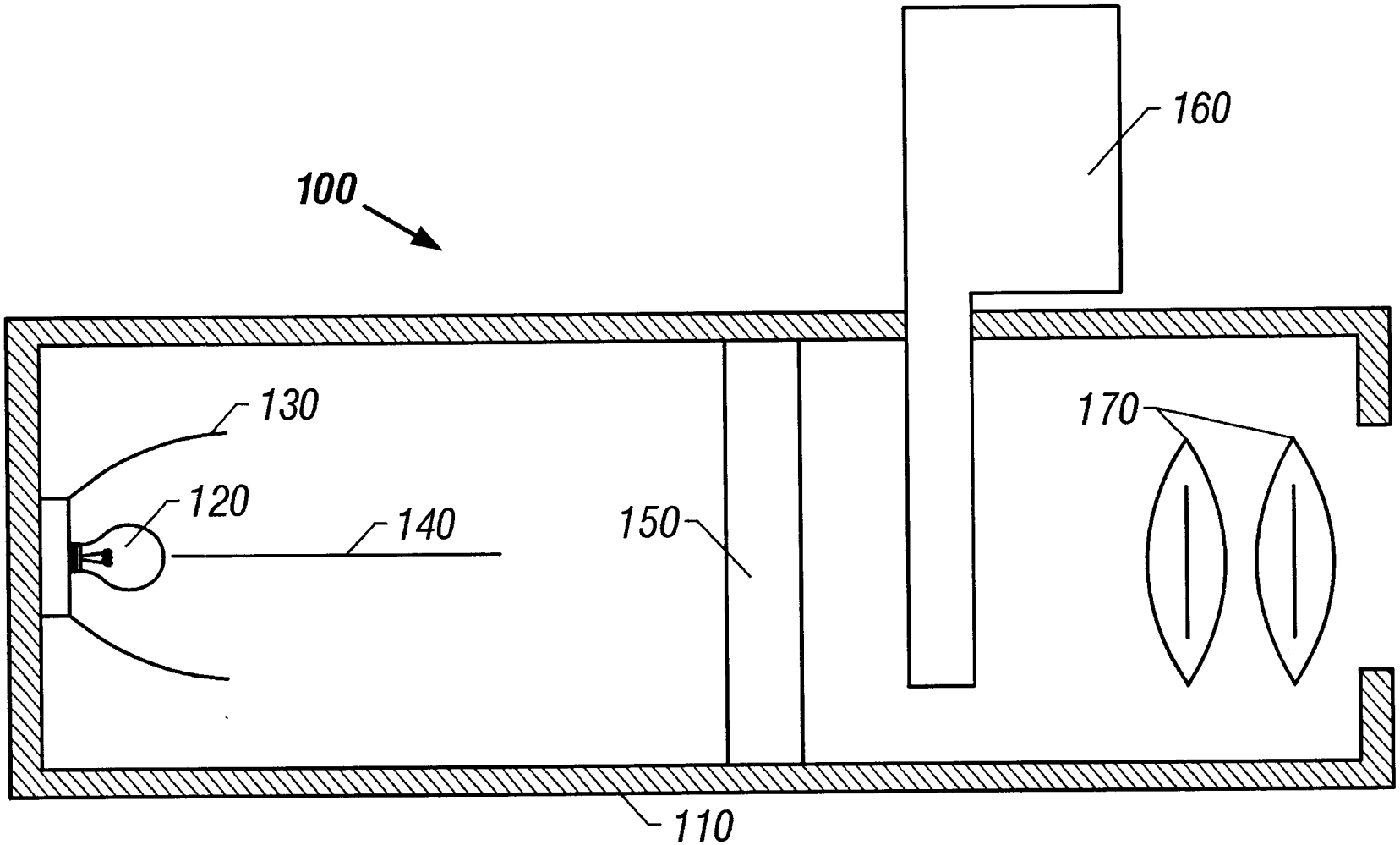
FIG. 1 is a schematic elevational view of a typical light projection system incorporating the linear effects device of the present invention.

As shown in FIG. 1, a remotely controllable fixture 100 comprises an elongated, generally cylindrical fixture housing 110 which includes a light source for producing a white beam of light, such as HPL compact filament lamp 120. A reflector 130 is positioned around filament lamp 120 to reflect any light which is directed other than generally parallel to optical axis 140. Preferably, the reflector 130 is a faceted dichroic reflector for reflecting infrared and ultraviolet energies.

The light beam emanating from the lamp/reflector assembly is incident on a shutter 150, which may be operated between a closed position, which allows no light to pass, and an open position, which permits all incident light to pass. When the shutter 150 is open, the light beam may be modified by passage through a motor-operated linear effects device 160 of the present invention having two rotating linear effects wheels or discs, as more fully described hereinafter. The modified light beam then passes through one or more lenses 170 prior to exiting the fixture housing 110. Lenses 170 may be used for providing a zoom effect and adjusting beam focus and/or divergence.

Figure 2B:
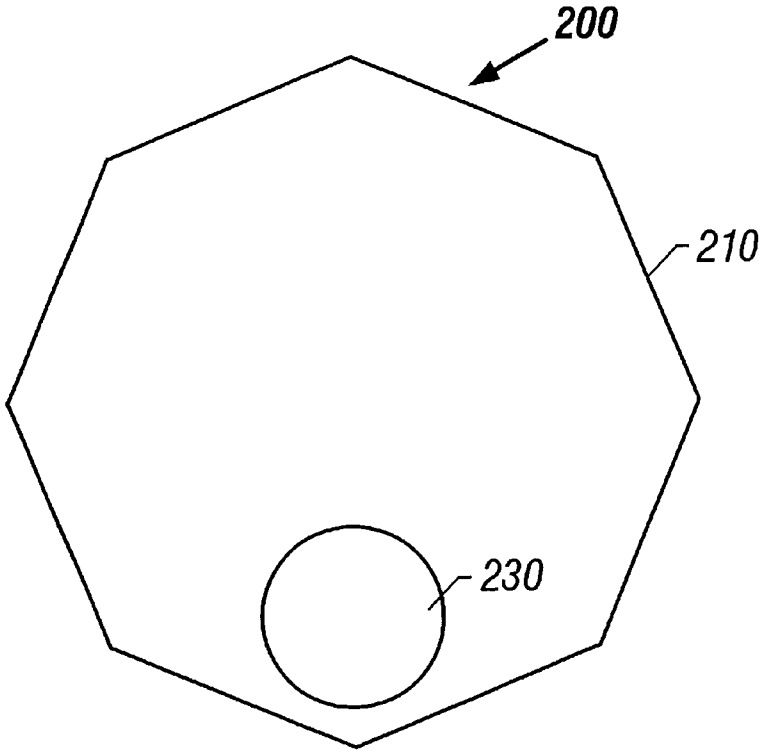
FIGS. 2A and 2B are front elevational views of the linear effects device of the present invention for independently and simultaneously rotating two effects discs within a single optical axis.
Figure 2A:
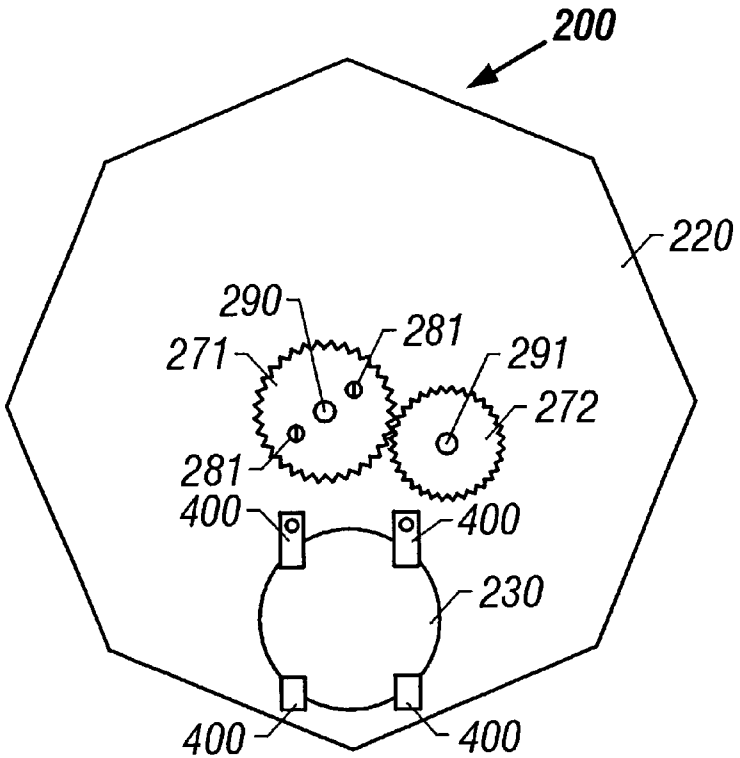
Figure 3:
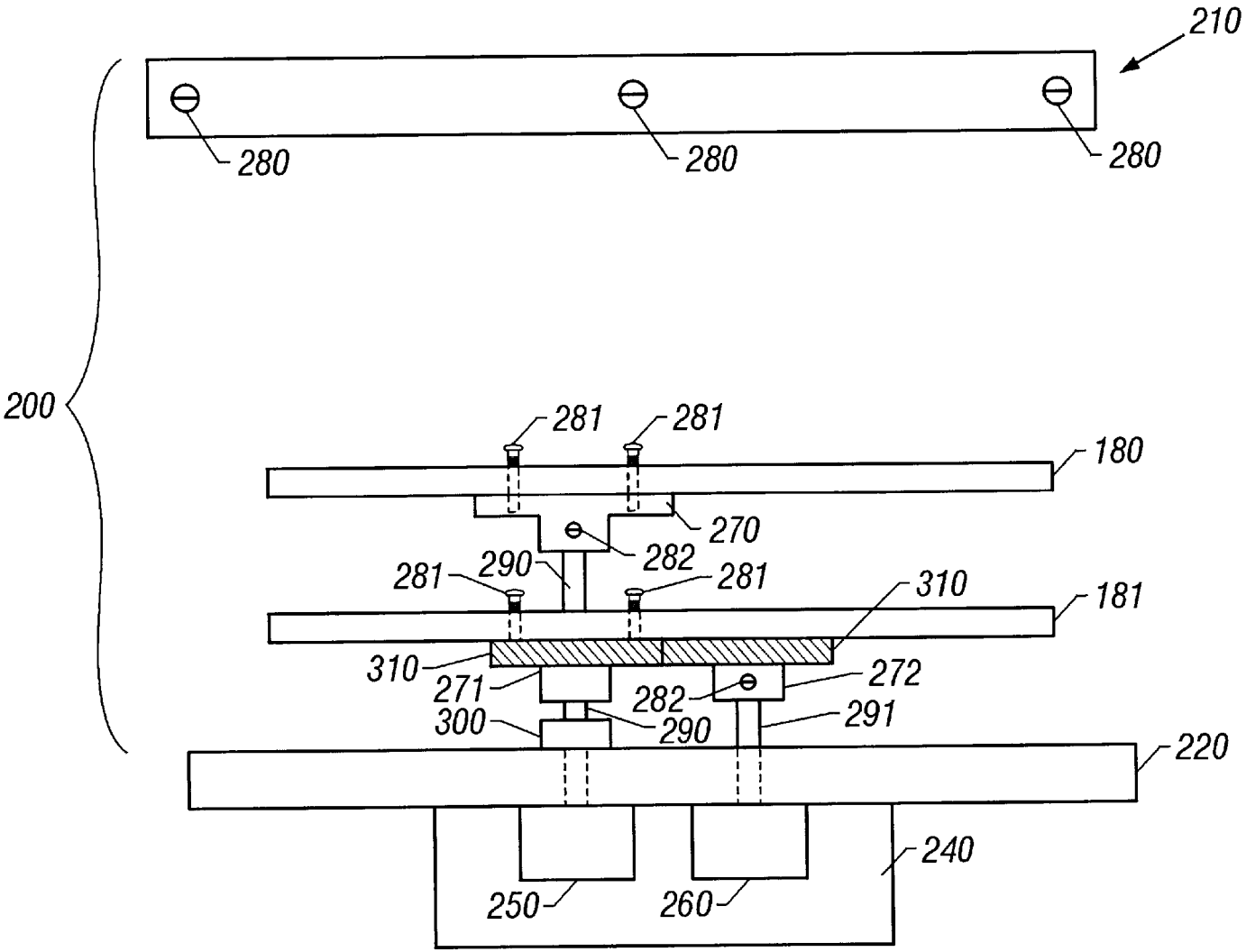
FIG. 3 is a side elevational view of the linear effects device of the present invention for independently and simultaneously rotating two effects discs within a single optical axis.

Referring to FIGS. 2A, 2B and 3 the linear effects device 160 of the present invention for independently and simultaneously rotating a first effects disc 180 (FIG. 3) and a second effects disc 181 (FIG. 3) about a single axis includes a generally circular or polygonally shaped disc housing 200. The disc housing 200 includes an upper cover 210 (FIG. 2A) and a lower cover 220 (FIG. 2B), each having a circular projection opening 230 to permit light to pass. The upper cover 210 is connected to the lower cover 220 by aligning the two projection openings 230 with each other and placing the upper cover 210 over the lower cover 220. As shown in FIG. 3, screws 280 (or other suitable fastening means) are tightened on the perimeter of the upper cover 210 to connect the upper cover 210 and the lower cover 220 to form the disc housing 200. The lower cover 220 is also attached to a motor housing 240 which includes a first motor 250 and a second motor 260 for independently rotating the first and second effects discs 180 and 181, respectively. Preferably, the lower cover 220 may also include template holders 400 for mounting a static template 410 (not shown).

The first effects disc 180 is mounted on a first hub 270 using mounting screws 281 or other comparable fastening means. The first hub 270 is connected to a shaft 290 of the first motor 250 by screw 282 or other suitable fastening means. The shaft 290 extends from the motor housing 240 and into the center of the disc housing 200 through the lower cover 220 and through the second effects disc 181. The first motor 250 rotates the first hub 270 and the first effects disc 180 by rotating the shaft 290. That is, the first effects disc 180 is rotated around an axis that is generally parallel to an optical axis, i.e., the path of the light travel. Accordingly, the first motor 250 controls direction and speed at which the first effects disc 180 is rotated.

The second effects disc 181 is mounted on a second hub 271 using screws 281 or other suitable fastening means. The second hub 271 sits on top of the rim of a bearing 300 and rotates around the shaft 290, but the second hub 271 is not physically connected to the shaft 290. That is, the second hub 271 is rotated by a shaft 291 of the second motor 260, independent of the shaft 290 of the first motor 250. Gear teeth 310 are formed on the outer periphery of the second hub 271.

The shaft 291 extends from the motor housing 240 and into the disc housing 200 adjacent to the shaft 290. A third hub 272 is connected to the shaft 291 of the second motor 260 by the screw 282 or other suitable fastening means. Gear teeth 310 are formed on the outer periphery of the third hub 272 to engage the second hub 271. The second motor 260 rotates the shaft 291 to rotate the third hub 272, which in turn rotates the second hub 271 around the same axis as the first hub 270. Accordingly, the second motor 260 controls the direction and speed at which the second effects disc 181 is rotated.

It is appreciated that since the first effects disc 180 is located further than the second effects disc 181 from the motor housing 240, and both effects disc rotate around the same axis, the shaft 291 does not extend beyond the second hub 271. Otherwise, the shaft 291 may interfere with the rotation of the second effects disc 181.

The manner in which the linear effects device 160 provides linear effects capability to the illumination device of FIG. 1 by independently rotating one of two effects discs within the path of the light beam to change the shape of the continuous image pattern or to add shaded areas to the continuous image pattern is now explained. The light beam passing through the shutter 150 is incident on the projection opening 230 located on the upper cover 210 of the disc housing 200. As the light passes through the disc housing 200, it is incident on a portion of the rotating first effects disc 180, where it is modified to form a desired continuous image, such as clouds, snow, fire, rain or the like. The rotational speed of the first effects disc 180 may be varied to create a single plane of linear motion, such as fast moving clouds or slow moving clouds.

In accordance with another embodiment of the present invention, the light beam is further modified by the passage through the rotating second effects disc 181 to create linear effects with the light beam, such as creating two planes of linear motion by varying the continuous image generated by the first effects disc 180. The two planes of linear motion is formed from the interaction between the two linear effects discs 180 and 181 to provide more realistic and random image patterns with greater depth of field than using one effects disc. The desired linear effects are created by independently controlling the rotational direction and speed of the first and second effects discs 180 and 181 having suitable image patterns. For example, the placid clouds generated by first effects disc 180 may be suddenly turned (modified) into storm clouds by the second effects discs 181, gently falling rain drops may be modified into a torrential downpour, gently falling snow flakes may be modified into a blizzard or the like. In other words, the rotational speed of the first and/or second effects discs 180 and 181 having image patterns for rain drops may be increased to change the gently falling rain drops into a heavy rain fall and increased further to create a torrential downpour.

In yet another embodiment, the light beam can be further modified by a static template (not shown) having an image of a desired object and being mounted in the template holders 400 (FIG. 2A). For example, the static template may contain an image pattern of trees to project an image of clouds passing over a stand of trees or the like. Custom art work may be used on the template to create a customized image pattern.

Figure 4:
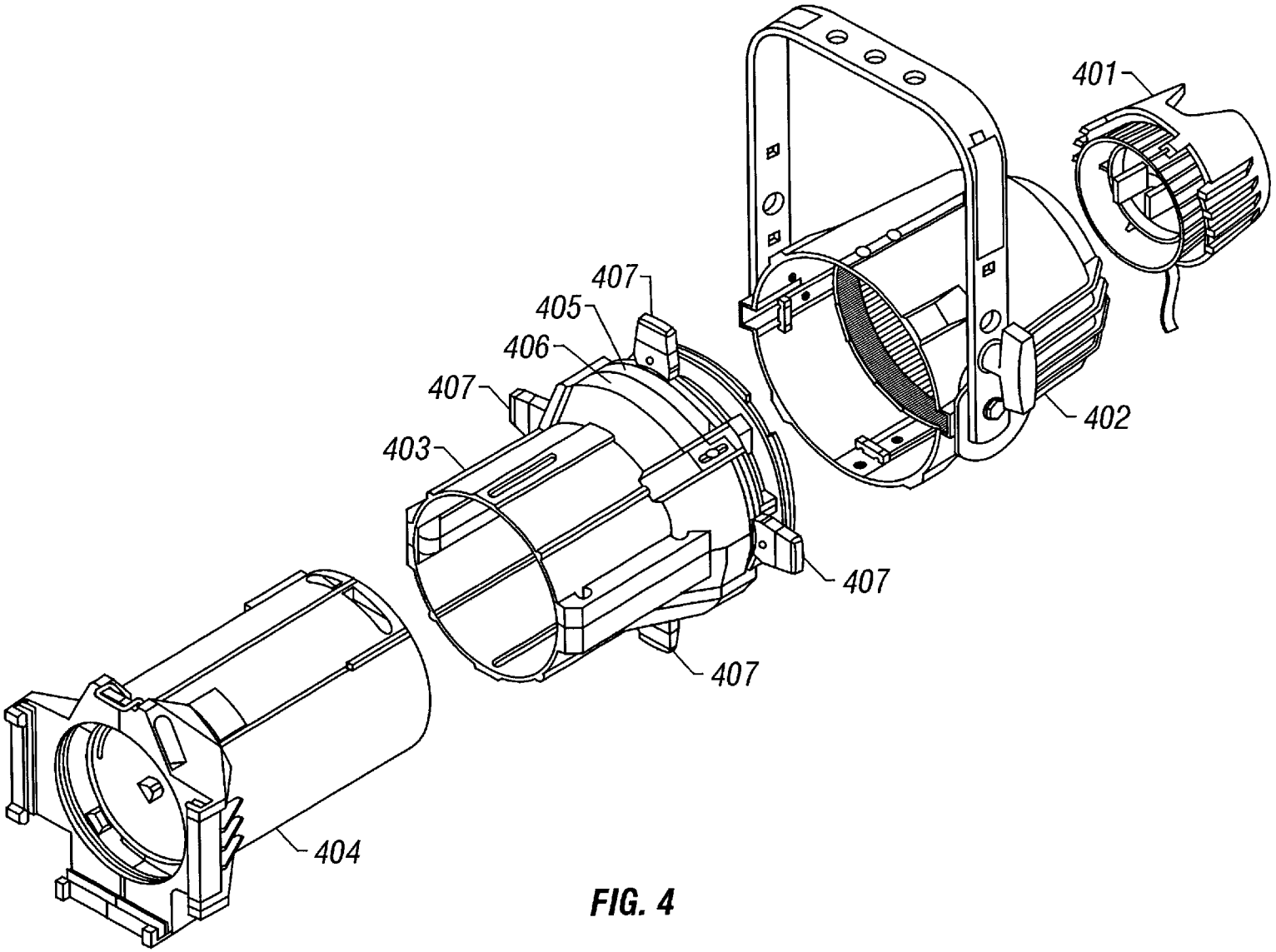
FIG. 4 is a schematic elevational view of an illumination system incorporating the linear effects device of the present invention.

In accordance with a further embodiment of the present invention, the linear effects device 160 is operable with an ETC SOURCE FOUR, a spotlight sold by Electronic Theatre Controls, Inc. The ETC SOURCE FOUR spotlight (FIG. 4) comprises a lamp socket assembly 401 , a reflector housing assembly 402, a front barrel assembly 403 and a lens tube assembly 404.

The front barrel assembly 403 includes shutters 407, a pattern holder slot 405 and a drop-in iris slot 406. The drop-in iris slot 406 may be modified to mount the linear effects device 160 of the present invention. The linear effects device 160 having a octagonally shaped disc housing is insertable into the modified drop-in iris slot 406 of the front barrel assembly 403 to provide linear effects capabilities to the ETC SOURCE FOUR spotlight.

While the present invention has been particularly described with respect to the illustrated embodiment, it will be appreciated that various alterations, modifications and adaptations may be made based on the present disclosure, and are intended to be within the scope of the present invention. It is intended that the appended claims be interpreted as including the embodiment discussed above, those various alternatives which have been described and all equivalents thereto.

What is claimed:

1. A linear effects apparatus for use in an illumination system, comprising:

a first effects disc containing a first continuous image pattern and a second effects disc containing a second continuous image pattern therewithin, said first and second effects discs being independently rotatable wherein only a portion of each effects disc and only a portion of each continuous image pattern therewithin are positioned in the path of a beam of light projected by said illumination system such that light passes through only said portion of each continuous image pattern of said first and second effects discs;

wherein a continuous image of said first continuous image pattern can be projected when said fist effects disc is rotated; and wherein said second effects disc is rotatable to modify said continuous image.

2. The apparatus of claim 1, further comprising:

a first motor within a motor housing for independently and controllably rotating said first effects disc across said beam of light projected by said illumination system to generate said continuous image of said first continuous image pattern; and a second motor within said motor housing for independently and controllably rotating said second effects disc across said beam of light projected by said illumination system to modify said continuous image.

3. The apparatus of claim 1, wherein said continuous image is modified in accordance with said second continuous image pattern.

4. The apparatus of claim 1, wherein said continuous image is modified in accordance with the rotational speed and direction of said first effects disc and said second effects disc.

5. The apparatus of claim 1, further comprising holders for mounting a static template having an image of an object.

6. A linear effects apparatus for use in an illumination system, comprising:

a first effects disc containing a first continuous image pattern therewithin, said first effects disc being rotatable wherein only a portion of said first continuous image pattern of said first effects disc is positioned in the path of a beam of light projected by said illumination system such that light passes through only said portion of said continuous image pattern of said first effects disc; and wherein a continuous image of said first continuous image pattern can be projected when said first effects disc is rotated.

7. The apparatus of claim 6, further comprising:

a first motor within a motor housing for controllably rotating said first effects disc across said beam of light projected by said illumination system to generate said continuous image of said first continuous image pattern.

8. The apparatus of claim 6, wherein said continuous image is modified in accordance with the rotational speed and direction of said first effects disc.

9. The apparatus of claim 6, further comprising holders for mounting a static template having an image of an object.

* * * * *